US007757513B2

(12) United States Patent
Paine

(10) Patent No.: US 7,757,513 B2
(45) Date of Patent: Jul. 20, 2010

(54) ICE STORAGE AND BAGGING SYSTEM

(76) Inventor: Robert A. Paine, 3626 E. 7th St., Superior, WI (US) 54880

( * ) Notice: Subject to any disclaimer, the term of this patent is extended or adjusted under 35 U.S.C. 154(b) by 78 days.

(21) Appl. No.: 12/173,577

(22) Filed: Jul. 15, 2008

(65) Prior Publication Data

US 2010/0011706 A1 Jan. 21, 2010

(51) Int. Cl.
*F25C 5/18* (2006.01)
*B65B 1/32* (2006.01)

(52) U.S. Cl. ..... 62/344; 532/502; 532/570

(58) Field of Classification Search ..... 62/344; 53/502, 503, 570
See application file for complete search history.

(56) References Cited

U.S. PATENT DOCUMENTS

| | | | | |
|---|---|---|---|---|
| 3,151,668 | A | 10/1964 | Zimmermann | |
| 3,543,811 | A * | 12/1970 | Atkins et al. | 141/9 |
| 3,807,193 | A | 4/1974 | McKenney et al. | |
| 3,918,266 | A | 11/1975 | Gindy et al. | |
| 4,084,725 | A | 4/1978 | Buchser | |
| 4,139,029 | A | 2/1979 | Geraci | |
| 4,252,002 | A | 2/1981 | Mullins, Jr. | |
| 4,368,608 | A | 1/1983 | Ray | |
| 4,846,381 | A | 7/1989 | Kito et al. | |
| 5,109,651 | A | 5/1992 | Stuart | |
| 5,277,016 | A | 1/1994 | Williams et al. | |
| 5,473,865 | A * | 12/1995 | Tanaka et al. | 53/502 |
| 5,581,982 | A | 12/1996 | Schroeder et al. | |
| 5,630,310 | A * | 5/1997 | Chadwell | 53/502 |
| 6,112,539 | A | 9/2000 | Colberg | |
| 6,401,437 | B1 * | 6/2002 | Kono | 53/502 |
| 6,474,048 | B1 | 11/2002 | Metzger et al. | |
| 6,904,946 | B2 * | 6/2005 | James | 141/313 |
| 6,932,124 | B2 | 8/2005 | Dalton et al. | |
| 7,104,291 | B2 | 9/2006 | Dalton et al. | |
| 2006/0005553 | A1 * | 1/2006 | Metzger | 62/135 |
| 2008/0283145 | A1 * | 11/2008 | Maxwell | 141/114 |

* cited by examiner

*Primary Examiner*—William E Tapolcai

(57) ABSTRACT

An ice storage and bagging system for automatically bagging ice and dispensing the bagged ice to a customer. The ice storage and bagging system generally includes a storage bin to store a plurality of ice cubes, an ice dispensing machine to transfer the plurality of ice cubes from the storage bin and a bagging system to receive the plurality of ice cubes from the ice dispensing machine to within a bag, wherein the bag is filled with a predetermined amount of the ice cubes. A delivery system transfers the filled bag of ice cubes from the bagging system to a customer and a purchasing system activates the ice dispensing machine to fill the bag with the plurality of ice cubes to be delivered to the customer in an automated manner. The ice may also be formed via a forming machine prior to being stored within the storage bin to completely automate the present invention.

1 Claim, 11 Drawing Sheets

ICE STORAGE AND BAGGING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to ice bagging and more specifically it relates to an ice storage and bagging system for automatically bagging ice and dispensing the bagged ice to a customer.

2. Description of the Related Art

Any discussion of the related art throughout the specification should in no way be considered as an admission that such related art is widely known or forms part of common general knowledge in the field.

Individuals have been using bags of ice for years in many applications. To produce a bag of ice, the ice must generally be bagged, transported to a sale location where the bagged ice may be purchased by the consumer. To bag and transport the ice generally requires expensive equipment, such as cooler trucks and also generally requires an extensive labor force, such as truck drivers. All of this increases the cost and waste produced to manufacture and sell bags of ice. Because of the inherent problems with the related art, there is a need for a new and improved ice storage and bagging system for automatically bagging ice and dispensing the bagged ice to a customer.

BRIEF SUMMARY OF THE INVENTION

The general purpose of the present invention is to provide an ice storage and bagging system that has many of the advantages of the ice bagging systems mentioned heretofore. The invention generally relates to an ice bagging system which includes a storage bin to store a plurality of ice cubes, an ice dispensing machine to transfer the plurality of ice cubes from the storage bin and a bagging system to receive the plurality of ice cubes from the ice dispensing machine to within a bag, wherein the bag is filled with a predetermined amount of the ice cubes. A delivery system transfers the filled bag of ice cubes from the bagging system to a customer and a purchasing system activates the ice dispensing machine to fill the bag with the plurality of ice cubes to be delivered to the customer in an automated manner. The ice may also be formed via a forming machine prior to being stored within the storage bin to completely automate the present invention.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide an ice storage and bagging system for automatically bagging ice and dispensing the bagged ice to a customer.

Another object is to provide an ice storage and bagging system that connects and works with a preexisting ice forming and dispensing machine.

An additional object is to provide an ice storage and bagging system that may be used by customers 24 hours a day and seven days a week, wherein the present invention is automated.

A further object is to provide an ice storage and bagging system that delivers ice to the customer in a manner so as to reduce cross-contamination.

Another object is to provide an ice storage and bagging system that may be used to fill bags with various amounts of ice.

Another object is to provide an ice storage and bagging system that automatically alerts maintenance as needed.

Another object is to provide an ice storage and bagging system that is stationary or portable to automatically bag ice and dispense the bagged ice to a customer.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
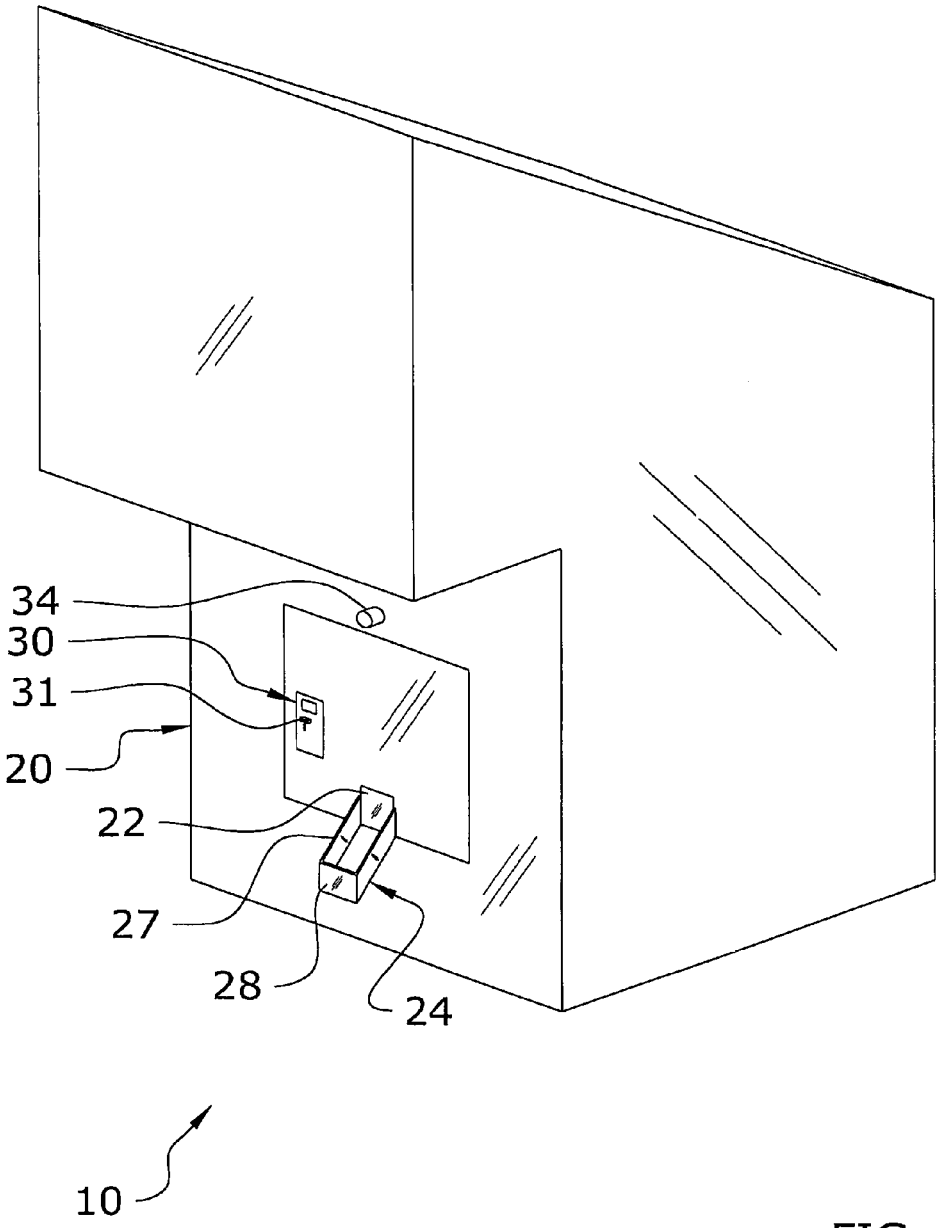
FIG. 1 is an upper perspective view of the enclosure.
Figure 2:
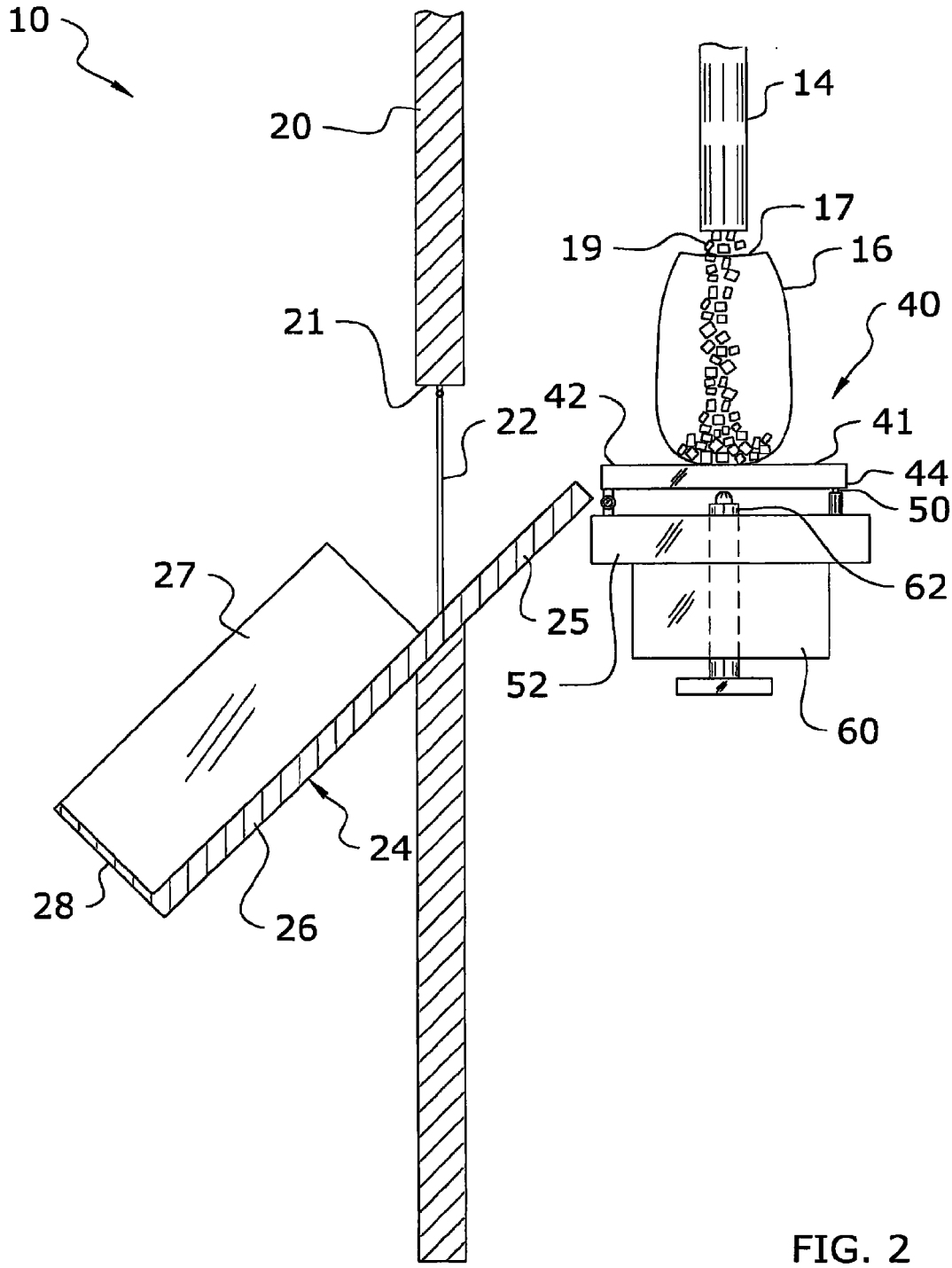
FIG. 2 is a side view illustrating the bag being filled with ice cubes.
Figure 3:
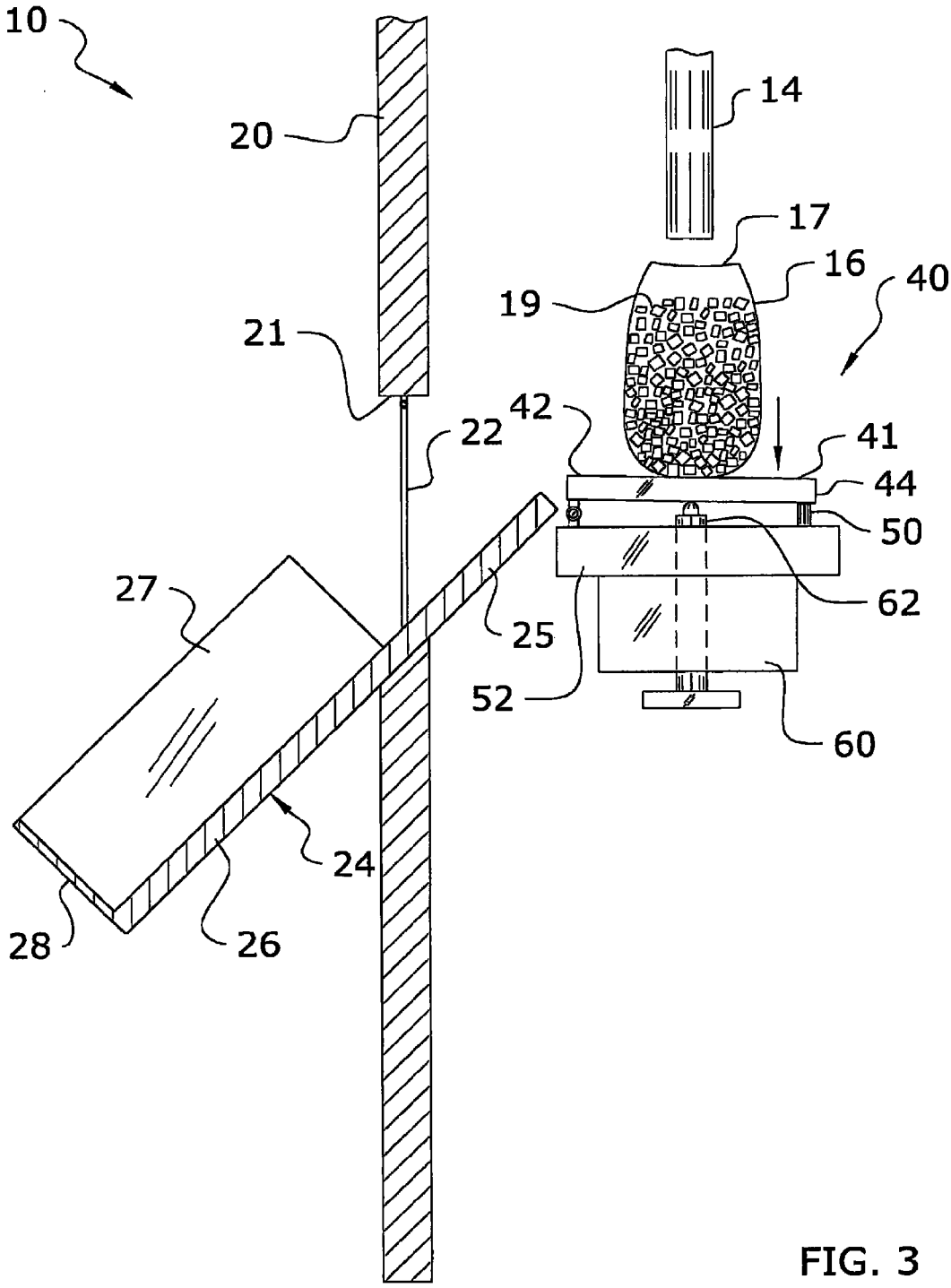
FIG. 3 is a side view illustrating the bag filled with ice cubes to the predetermined weight so as to depress the switch and turn off the dispensing machine.
Figure 4:
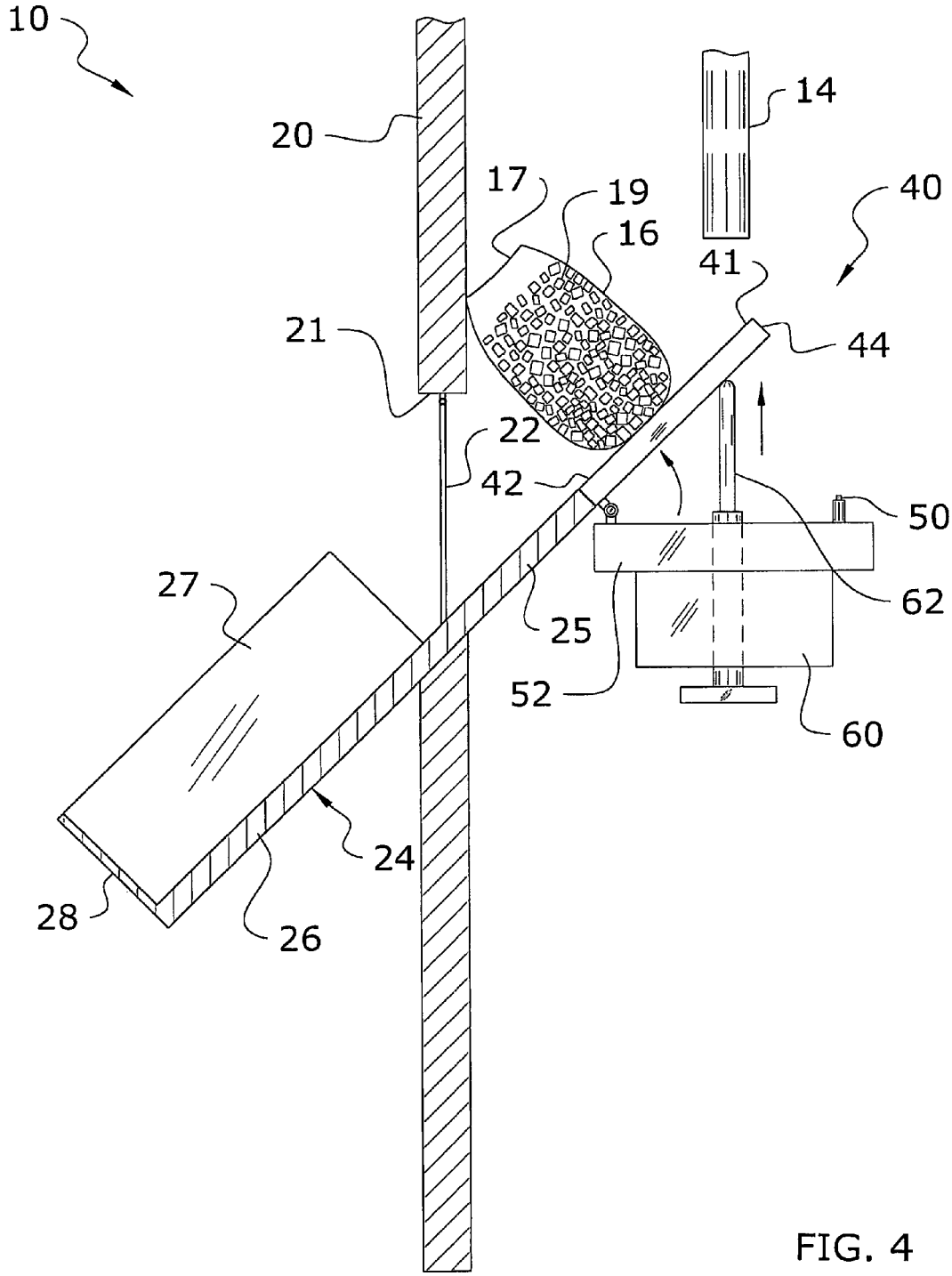
FIG. 4 is a side view illustrating the actuators pivoting the platform and filled bag of ice.
Figure 5:
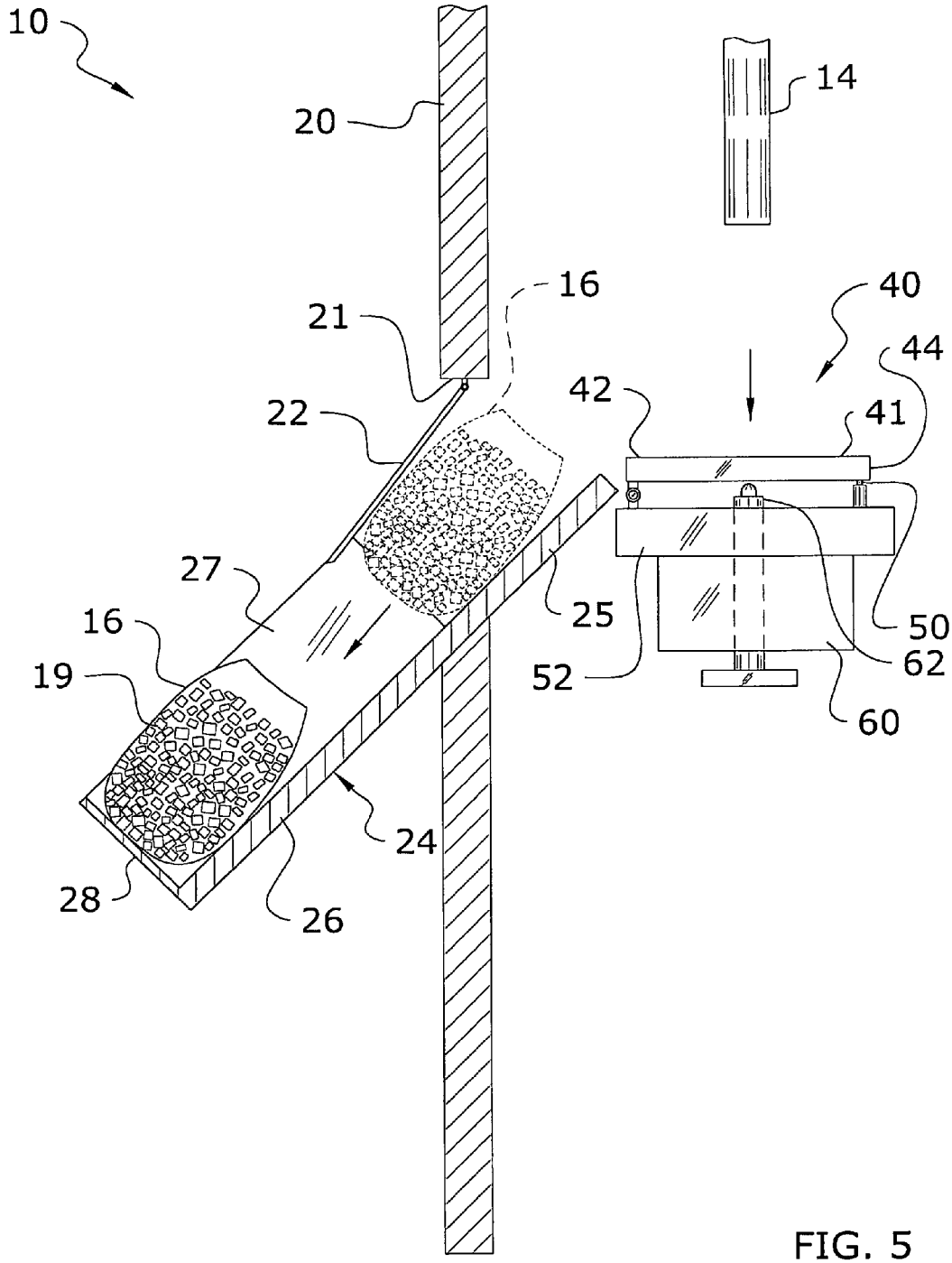
FIG. 5 is a side view illustrating the filled bag of ice sliding down the chute toward the customer.
Figure 6:
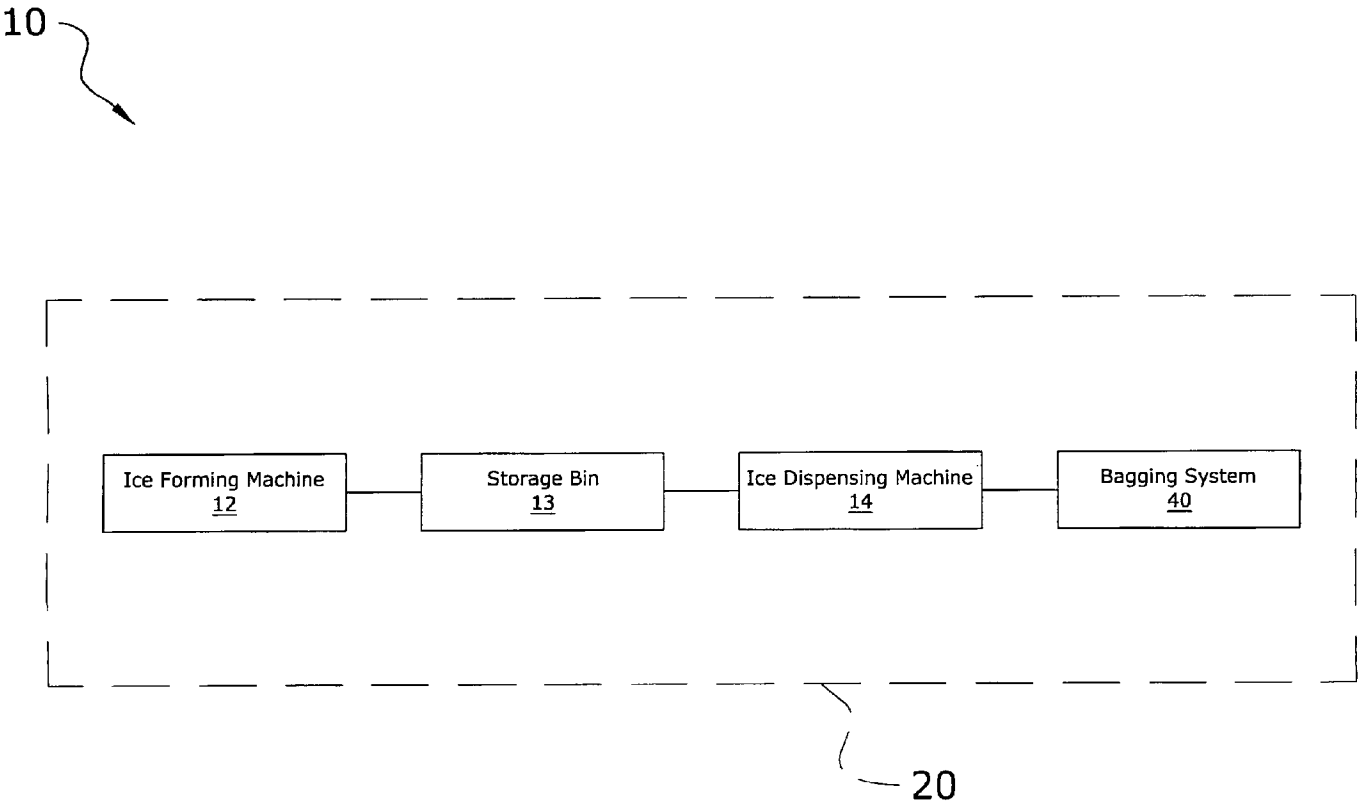
FIG. 6 is a block diagram illustrating the present invention.
Figure 7:
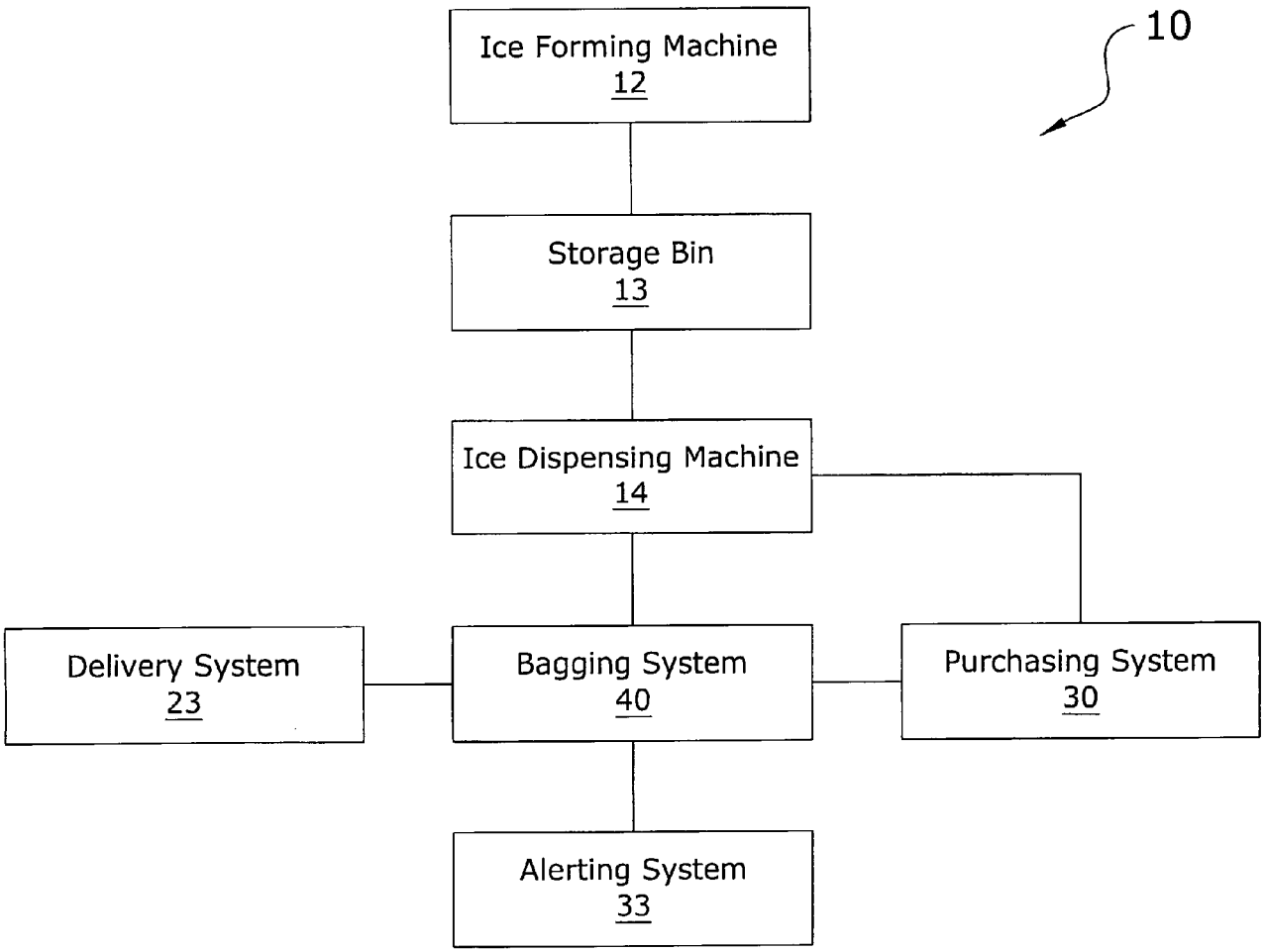
FIG. 7 is a detailed block diagram of the present invention.
Figure 8:
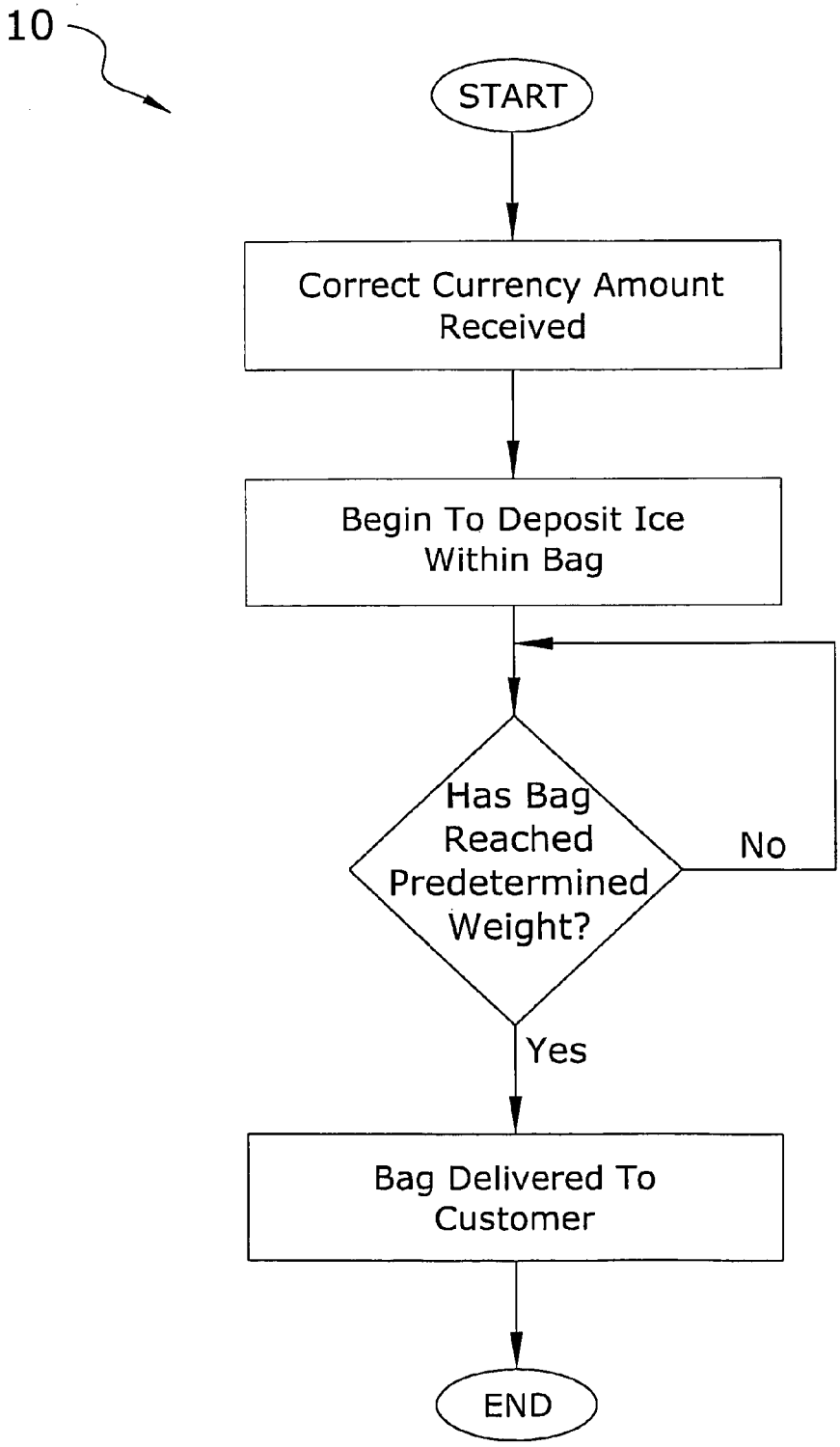
FIG. 8 is a flowchart illustrating a general process of the present invention from a customer point of view.
Figure 9:
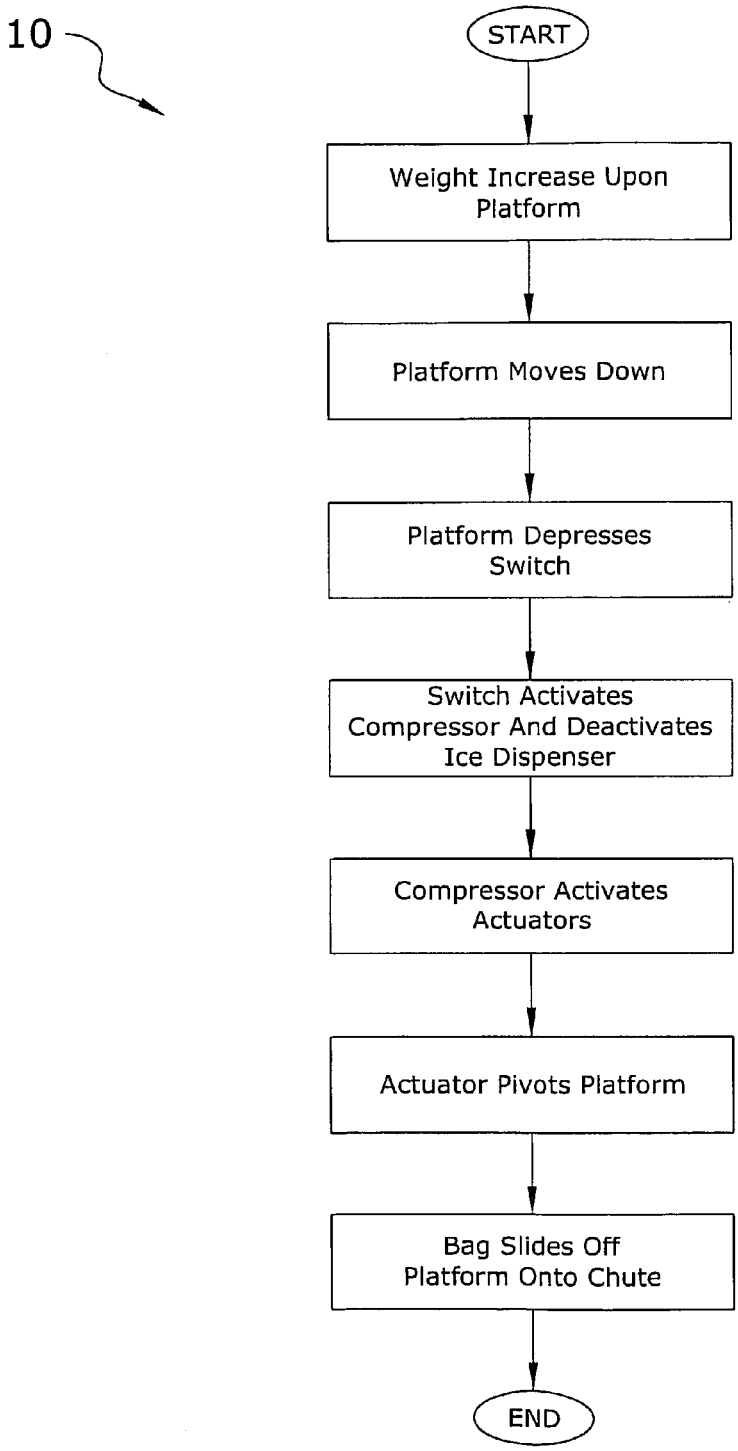
FIG. 9 is a flowchart illustrating a process of the bag filling with ice cubes.
Figure 10:
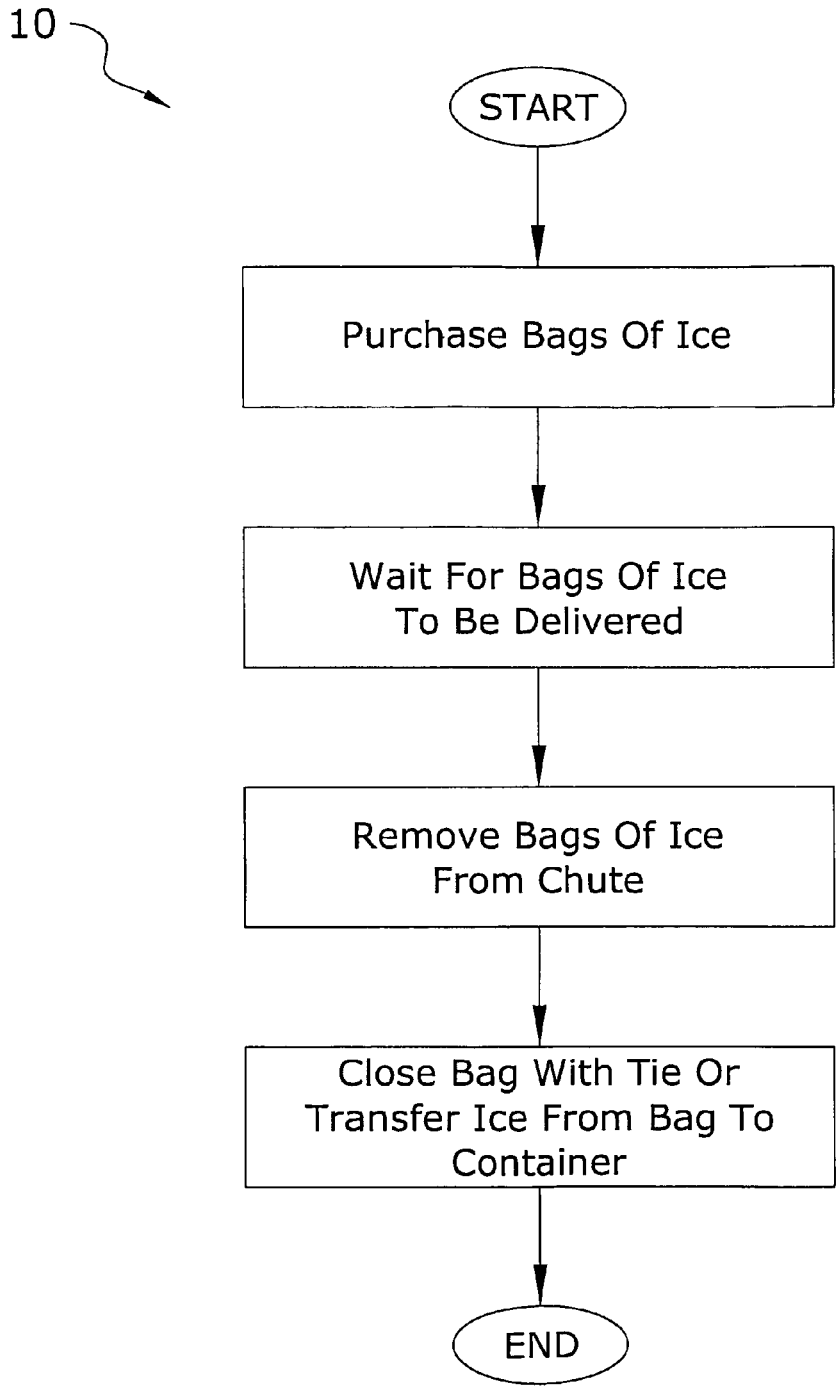
FIG. 10 is a flowchart illustrating a process of the platform activating the switch and the bag sliding off of the platform.
Figure 11:
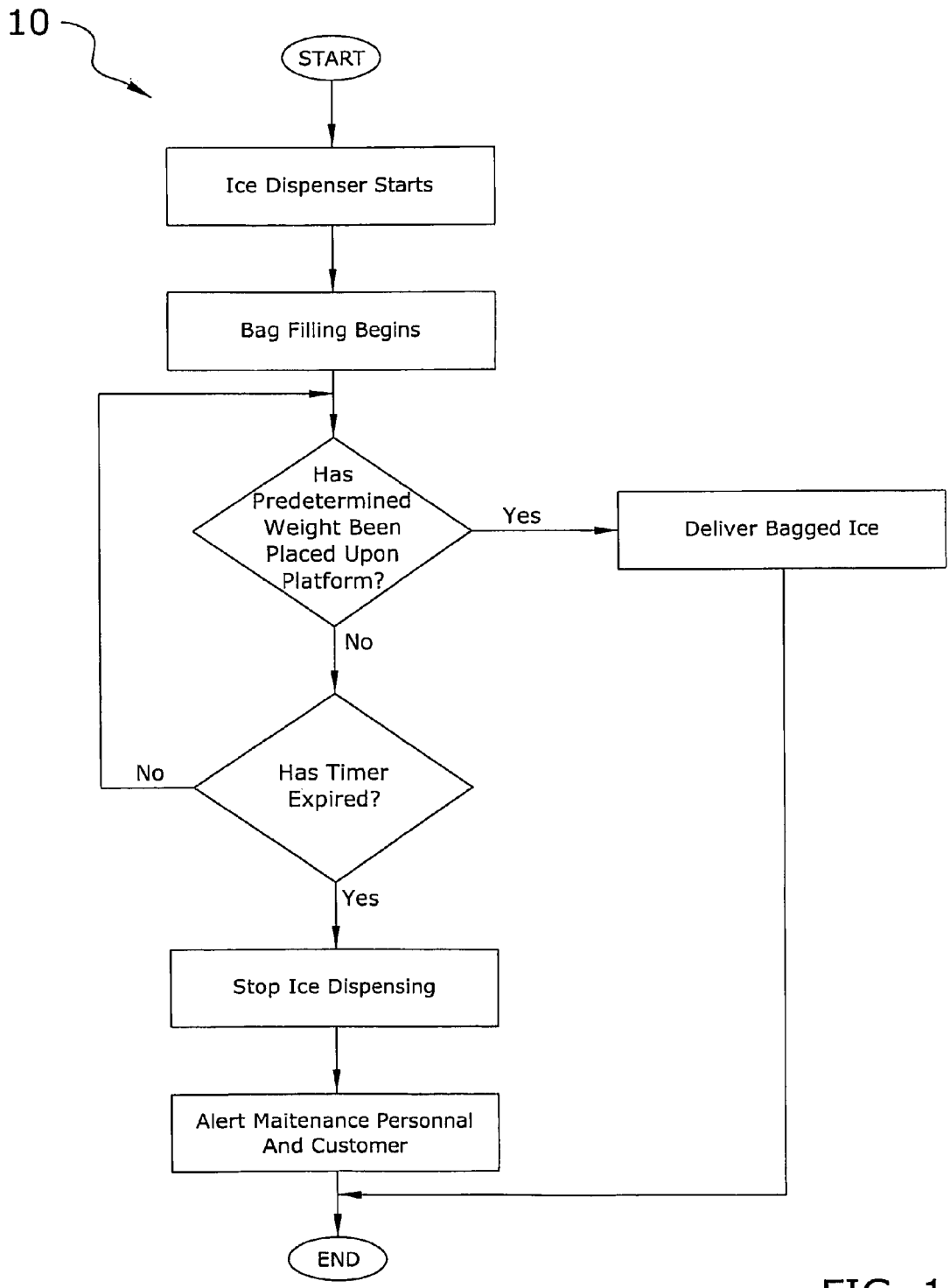
FIG. 11 is a flowchart illustrating a process of the timer expiring and activating the alert system.

Turning now descriptively to the drawings, in which similar reference characters denote similar elements throughout the several views, FIGS. 1 through 11 illustrate a ice storage and bagging system 10, which comprises a storage bin 13 to store a plurality of ice cubes 19, an ice dispensing machine 14 to transfer the plurality of ice cubes 19 from the storage bin 13 and a bagging system 40 to receive the plurality of ice cubes 19 from the ice dispensing machine 14 to within a bag 16, wherein the bag 16 is filled with a predetermined amount of the ice cubes 19.

A delivery system 23 transfers the filled bag 16 of ice cubes 19 from the bagging system 40 to a customer and a purchasing system 30 activates the ice dispensing machine 14 to fill the bag 16 with the plurality of ice cubes 19 to be delivered to the customer in an automated manner. The ice cubes 19 may also be formed via a forming machine 12 prior to being stored within the storage bin 13 to completely automate the present invention.

B. Ice Forming Machine

The present invention preferably uses and connects to a preexisting ice forming machine 12. The ice forming machine 12 is capable of forming large amounts of cubed ice cubes 19 and delivering the ice cubes 14 to the storage bin 13. The ice forming machine 12 is also adapted to fit within the enclosure 20 and be concealed from outside view. The ice forming machine 12 may include a storage bin 13 to store the ice cubes 19. It is appreciated that the ice forming machine 12 may be connected to a water source so as to maintain the storage bin 13 filled with ice cubes 19 as the ice cubes 19 is transferred to the bag 16 by the dispensing machine. The storage bin 13 may also be periodically filled, wherein the ice cubes 19 need not be formed within the enclosure 20.

C. Ice Dispensing Machine

The present invention also preferably uses and connects to a preexisting ice dispensing machine 14. The ice dispensing machine 14 collects the ice cubes 19 from the ice forming machine 12 and dispenses the ice cubes 19 within the bag 16. The ice dispensing machine 14 may include an auger or other mechanism to move the ice cubes 19 from a storage bin 13 to within the bag 16. The ice dispensing machine 14 is also connected to the switch 50 and to the currency acceptor 31. The ice dispensing machine 14 is activated when a proper amount of currency is deposited within the currency acceptor 31 and stopped when either a timer expires or the switch 50 is engaged. The ice dispensing machine 14 is also adapted to fit within the enclosure 20 and be concealed from outside view.

C. Enclosure

The present invention includes an enclosure 20 to conceal the inner workings of the present invention, the ice forming machine 12, ice storage bin 13 and ice dispensing machine 14 from outside view. The enclosure 20 is comprised of a structure that may be comprised of an outside stored configuration or an inside stored configuration. The enclosure 20 may include various access doors to access the inside of the enclosure 20. The enclosure 20 can also be built on a trailer to make the present invention portable.

D. Delivery System

A delivery system 23 delivers the filled bags 16 from the bagging system 40 to the customer in an automated manner. The delivery system 23 includes a chute 24 extending from inside the enclosure 20 and extend to the outside of the enclosure 20 through an opening 21 in the enclosure 20 so as to deliver the bag 16 of ice cubes 19 to the customer. The opening 21 is thus large enough to accommodate both the bag 16 of ice cubes 19 and the chute 24. A movable flap 22 may also extend over the opening 21, wherein the flap 22 is preferably pivoted toward an open position as the bag 16 of ice cubes 19 travels from inside of the enclosure 20 to outside of the enclosure 20 through the opening 21. The flap 22 then preferably moves back to a closed position to receive the next bag 16.

The chute 24 includes an inside portion 25 to receive the bag 16 of ice cubes 19 from the platform 41 and an outside portion 26 to deliver the bag 16 of ice cubes 19 to the customer. The outside portion 26 may include sidewalls 27 and an end wall 28 to prevent the bag 16 of ice cubes 19 from falling off of the chute 24. The chute 24 is further angled downward so as to allow the bag 16 of ice cubes 19 to slide down the chute 24 toward the outside portion 26.

E. Purchasing System

The present invention includes a purchasing system 30 to start the automated process of filling the bags 16 with ice cubes 19 cubes and delivering the filled bags 16 to the customer. The purchasing system 30 includes a currency acceptor 31 so as to allow the present invention to be substantially unmanned in that the currency acceptor 31, once a correct amount of currency has been received, starts the ice dispensing machine 14 so as to fill the bag 16 with ice cubes 19. The currency acceptor 31 may be designed to accept various types of currency, such as but not limited to cash, coins, cards (e.g. credit, debit, gift) via a magnetic card reader. The currency acceptor 31 is preferably positioned upon an outside of the enclosure 20 near the chute 24.

The currency acceptor 31 may also include various controls to allow a customer to input the number of bags 16 of ice cubes 19 desired. The currency acceptor 31 is connected to various other controls that start the dispensing machine 14 once the correct amount of currency is deposited or accepted and the desired number of bags 16 of ice cubes 19 for purchase is inputted.

F. Alerting System

The present invention includes an alerting system 33 to alert maintenance personnel and the customer if there is any failure in filling the bags 16 with ice cubes 19. The alerting system 33 includes at least one alert light 34 and preferably two alert lights 34 positioned upon an outside of the enclosure 20, preferably near the chute 24. The alert light 34 informs the customer if there is a problem with the present invention filling the bags 16 with ice cubes 19 and delivering the bags 16 of ice cubes 19 to the customer. Once the alert light 34 illuminates, a signal may also be sent to a maintenance individual or crew to fix the associated problem. The signal sent to the maintenance personnel may sent through a telephone call, email or through various other manners.

G. Bagging System

The bagging system 40 functions in a manner so as to fill the bags 16 with ice cubes 19 received from the dispensing machine 14 and to transfer the filled bags 16 to the customer. The bagging system 40 includes a platform 41 in which the bag 16 is positioned upon when receiving the ice cubes 19. The platform 41 preferably functions in a manner similar to a scale as the platform 41 is adapted to move vertically down as force or poundage is put upon the upper surface of the platform 41. The platform 41 may include a resistance mechanism to adjust the rate at which the platform 41 moves downward with respect to the poundage placed upon the platform 41. The platform 41 is also pivotally attached to the bagging system 40 at a hinged end 42 of the platform 41. The hinged end 42 is preferably adjacent the chute 24.

A holder (not shown) may also be positioned proximate the platform 41 to secure the bags 16 in an upright position while being filled with ice cubes 19. The holder also serves to adequately position a new bag 16 for filling with ice cubes 19 after a previous bag 16 has been transferred to the chute 24 for retrieval by the customer. The bagging system 40 also includes a counter to count the number of bags 16 of ice cubes 19 that are delivered to customers. The counter may be used for various accounting purposes or purposes relating to notifying when the present invention needs to be service cubes 19*d*.

The bagging system 40 also includes a switch 50 to be engaged by the lower surface of the platform 41 once a sufficient force or poundage has been placed upon the upper surface of the platform 41. The switch 50 is preferably comprised of a micro switch. The switch 50 is also connected to the dispensing machine 14 and the compressor 60, wherein once the switch 50 has been engaged or depressed the dispensing machine is turned off and the compressor 60 is turned on. In the preferred embodiment the resistance on the platform 41 is set in such a manner so as to engage or depress the switch 50 when 8 pounds have been placed upon the upper surface of the platform 41 (i.e. 8 pounds of ice cubes 19); however it is appreciated that the resistance may be adjusted so as to allow for filling lighter or heavier bags 16 of ice cubes 19. Various supports 52 may be positioned throughout the bagging system 40 to secure the components of the bagging system 40.

The compressor is preferably comprised of an air compressor. The compressor 60 is connected to the switch 50 so as to be activated when the switch 50 is depressed. The compressor 60 activates at least one actuator 62 comprised of a hydraulic cylinder. It is appreciated that the actuators 62 may be comprised of hydraulic or electric actuators also. The actuator 62 moves the lifting end 44 of the platform 41 so as to cause the hinged end 42 and platform 41 to pivot (preferably at least 45 degrees) and allow the bag 16 of ice cubes 19 to slide upon the chute 24. The actuator 62 preferably extends in a straight vertical manner to engage and push up on the platform 41 when activated and to move away from and below the platform 41 when deactivated. The bagging system 40 may also include a timer to be used if the bag 16 is not filled and the switch 50 activated in an appropriate amount of time. The timer is connected to the alerting system 33, wherein a maintenance personnel and the customer is notified if the timer expires.

H. Operation of Preferred Embodiment

In use, the customer deposits a required amount of currency into the currency acceptor 31 and inputs the desired number of bags 16 of ice cubes 19. Any change owed to the customer may also be dispensed. After the customer inputs the desired number of bags 16 of ice cubes 19, the dispensing machine 14 begins to transfer the ice cubes 19 from the storage bin 13 to the bag 16 through the upper opening 17 of the bag 16.

As the bag 16 fills, the weight upon the platform 41 increases thus causing the platform 41 to move in a downward manner toward the switch 50. Once the predetermined weight (e.g. 8 pounds) has been placed upon the platform 41, the lower surface of the platform 41 engages and depresses the switch 50. Once the switch 50 is depressed, the dispensing machine 14 stops to prevent overfilling the bag 16 with ice cubes 19. The compressor 60 also starts. The compressor 60 is connected to the actuators 62 and causes the actuators 62 to extend and pivot with the platform 41 upwards.

As the platform 41 pivots (via the actuators 62 pushing upon the lifting end 44 of the platform 41), the bag 16 of ice cubes 19 slides off of the hinged end 42 of the platform 41 and onto the chute 24. The upper opening 17 is maintained in an upright position with respect to the direction of travel of the bag 16 so as to prevent the ice cubes 19 from falling out of the bag 16.

The upper opening 17 may be maintained in an upright position in various maimers, such as but not being pushed against the inside of the enclosure 20. The bag 16 of ice cubes 19 continues to slide down the chute 24 toward the customer. Once the bag 16 of ice cubes 19 is within the outside portion 26 of the chute 24, the customer may remove the bag 16 of ice cubes 19 in which the customer may seal the upper opening 17 closed if desired with provided ties or the customer may transfer the ice cubes 19 from the bag 16 to within another container (e.g. cooler).

If the present invention fails to fill the bag 16 for various reasons, such as but not limited to the storage bin 13 out of ice cubes 19, the upper opening 17 of the bag 16 not positioned properly, the bagging system 40 out of bags 16 or various others, a maintenance personnel and the customer is notified via the alerting system 33. The alerting system 33 is engaged via expiration of a timer. The timer starts as the dispensing machine begins to fill the bag 16.

If the switch 50 has not been engaged and the dispensing machine 14 has not been activated within a predetermined amount of time, the timer expires and the dispensing machine 14 is shut off along with the alerting system 33 activated. The predetermined amount of time is the amount of time it generally takes to fill the bag 16 with the amount of ice cubes 19 required to reach the weight (e.g. 8 pounds) that must be placed upon the platform 41 to engage the switch 50. It is appreciated that if the situation occurs in which the present invention is out of bags 16 or the bag 16 is misaligned so as to cause the dispensing machine to miss the bag 16 while dispensing the ice cubes 19, the required amount of weight will not be able to be stacked upon the platform 41 via the dispensing machine 14 and the ice cubes 19 will continue to fall off of the platform 41 causing the eventual expiration of the timer and activation of the alerting system 33.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An automated ice bagging system, comprising:

an ice forming machine to form a plurality of ice cubes;

a storage bin to store said plurality of ice cubes formed by said ice forming machine;

an ice dispensing machine to transfer said plurality of ice cubes from said storage bin;

a bagging system to receive said plurality of ice cubes from said ice dispensing machine to within a bag, wherein said bag is filled with a predetermined amount of said ice cubes;

wherein said bagging system includes a platform to support said bag and said plurality of ice cubes within said bag;

wherein said platform vertically adjusts as said bag fills with said plurality of ice cubes;

wherein said bagging system includes a switch, wherein said switch is engaged by said platform;

wherein said switch deactivates said ice dispensing machine;

wherein said platform pivotally adjusts;

wherein said bagging system includes at least one actuator to pivot said platform;

wherein said bagging system includes a timer to detect a failure of said bagging system;

a delivery system to transfer said filled bag of ice cubes from said bagging system to a customer;

wherein said delivery system transfers said filled bag of ice cubes from an inside of said enclosure to an outside of said enclosure;

a purchasing system to activate said ice dispensing machine to fill said bag with said plurality of ice cubes to be delivered to said customer in an automated manner;

wherein said purchasing system includes a currency acceptor;

an alerting system to alert a maintenance personnel of error in filling said bag with said plurality of ice cubes; and an enclosure to enclose said ice forming machine, said ice dispensing machine and said bagging system.

* * * * *